United States Patent [19]

Alario et al.

[11] Patent Number: 4,457,059

[45] Date of Patent: Jul. 3, 1984

[54] METHOD OF MAKING A RE-ENTRANT GROOVE HEAT PIPE

[75] Inventors: Joseph P. Alario, Hauppauge; Robert Kosson, Massapequa; Edward Leszak, Amityville, all of N.Y.

[73] Assignee: Grumman Aerospace Corporation, Bethpage, N.Y.

[21] Appl. No.: 381,336

[22] Filed: May 24, 1982

[51] Int. Cl.[3] ..... B21D 53/00

[52] U.S. Cl. ..... 29/157.3 H; 72/370; 72/256; 165/104.26

[58] Field of Search ..... 29/157.3 AH, 157.3 V, 29/157.3 A, 157.3 R; 72/283, 370, 256, 112, 479; 165/104.26, 133

[56] References Cited

U.S. PATENT DOCUMENTS 3,987,539 10/1976 Grauener ..... 72/370 X 4,004,441 1/1977 Leszak ..... 165/133 X

FOREIGN PATENT DOCUMENTS 56-49888 5/1981 Japan ..... 29/157.3 H

*Primary Examiner*—Carl E. Hall
*Assistant Examiner*—John T. Burtch
*Attorney, Agent, or Firm*—John P. Kozma; Richard G. Geib; Daniel J. Tick

[57] ABSTRACT

A sealed heat pipe of uniform cross sectional profile from evaporator to condenser which includes a plurality of capillary channels communicating with a central channel by means of narrow re-entrant groove openings having convergent entrances. A two step method of fabrication includes extruding the re-entrant grooves, then drawing a mandrel through the virgin extrusion.

4 Claims, 7 Drawing Figures

METHOD OF MAKING A RE-ENTRANT GROOVE HEAT PIPE

BACKGROUND

The present invention relates to heat pipes and in particular to heat pipes formed by the extrusion of a thermally conductive material through a die resulting in an axially grooved pipe of uniform cross section.

Conventional heat pipes operate to transfer heat from a heat source, where heat energy is produced or collected, to a heat sink, where the heat is stored or used. The usual configuration is a closed chamber containing a working fluid which absorbs heat by evaporation and releases heat by condensation in a continuous cycle. Thus the heat pipe may be characterized as having three sections: (1) an evaporator, located in the heat source region; (2) a condenser in the heat sink region; and (3) a transport section through which vaporized and liquid working fluid flow from the evaporator to the condenser and back.

A persistent problem in the design of heat pipes has been the provision of satisfactory means for moving the liquid working fluid from the condenser to the evaporator. Generally such means comprise capillary flow channels in or along the walls of the transport section, while the central region of the pipe's cross section is reserved for vapor flow in the opposite direction.

Several heat pipe designs incorporate a separate screen or mesh wicking element to supply capillary channels; examples are U.S. Pat. No. 3,971,435 and 4,116,266, issued to Peck and Sawata et al, respectively. While improving axial flow of the working fluid in the transport section, however, separate wicking elements invariably reduce heat transfer efficiency in the evaporator and condenser sections. Furthermore, the wicking elements must be produced by additional plating or forming techniques, and the performance of the heat pipe may suffer if there is any deformation of the wicking element during wick assembly or as a result of thermal stress.

U.S. Pat. No. 3,402,767, issued to Bohdansky et al, discloses a heat pipe having a plurality of narrow axial grooves which by themselves serve as capillary channels to transport the condensed working fluid, avoiding the problems of a separate wicking element. Again, however, the rectangular groove profile of Bohdansky is inefficient with respect to both the channelling of the condensed working fluid into the capillary grooves in the condenser area and in the transfer of heat through the working fluid, especially when the fluid has, as is typical, a low thermal conductivity.

The problem of optimizing the groove profiles for the evaporator, condenser and transport sections of an axially grooved heat pipe is addressed by U.S. Pat. Nos. 3,528,494 and 3,537,514, both issued to Levendahl. In essence, Levendahl proposes a distinct profile for each section of the heat pipe. An inner wall similar to that of Peck is suggested for use in the transport section only, so as not to impair the evaporator and condenser efficiencies. Levendahl further recognizes the effect on evaporator/condenser efficiency of varying the radius of curvature of the axial groove entrances. However, the Levendahl configuration requires that the individual evaporator, condenser and transport sections be formed separately and subsequently joined together, thus introducing considerable production costs.

In fact, production costs present a major obstacle in the design of an optimum groove profile. U.S. Pat. No. 3,566,651, issued to Tlaker, discloses a method for forming tubular parts by material displacement of the interior walls of a blank workpiece or pipe. Such deformation is accomplished by feeding the blank tube past a tapered mandrel and appropriately shaped die positioned within the tube. Another well known method for forming tubular parts is extrusion, which entails the feeding of the material from which the tube is formed past a die suspended by spider legs. The material is fed past the die in a semi-molten state, and fuses together as it passes the spider arms.

Both the Tlaker material displacement and the extrusion methods, while desirable from a low production cost standpoint, are limited with respect to the complexity of the axial groove configurations which may be formed thereby.

It would be of considerable advantage, therefore, to provide a heat pipe having optimum capillary flow means and heat transfer characteristics, yet which may be produced in meaningful quantities by economical techniques.

SUMMARY OF THE INVENTION

A principal object of the present invention is to provide an axially grooved heat pipe with improved heat transfer characteristics.

A further object of this invention is to provide an axial groove configuration which affords an efficient capillary flow channel for a heat pipe working fluid.

It is yet another object of the present invention to provide an axial groove heat pipe which operates with a relatively small inventory of working fluid.

A still further object is to provide an axially grooved heat pipe in which the same groove configuration is used uniformly throughout the length of the pipe.

Yet another object of this invention is to provide a groove profile for a heat pipe which optimizes the flow of condensed working fluid into the capillary channel of the groove, thereby improving condenser heat transfer efficiency.

A still further object of the present invention is to provide such an axial groove profile which promotes the formation of thin working fluid films in the evaporator section, thereby improving evaporator heat transfer efficiency.

It is yet one further object of the present invention to provide an efficient heat pipe which may be produced at low cost by existing fabrication techniques.

The above and other objects and advantages of the present invention are realized in brief by providing a heat pipe having a plurality of axial convergent re-entrant grooves. Optimum capillary flow in the transport section is assured by the use of a capillary channel having a re-entrant groove or opening which is narrower than the central portion of the channel itself. The re-entrant groove may be readily produced by extrusion methods.

The re-entrant groove profile is then modified by passing a mandrel having a plurality of serrations in registry with the re-entrant grooves through the heat pipe. This modification results in a narrower entrance with tapering or convergent surfaces leading to the groove itself. The narrower entrance allows a further reduction in working fluid inventory over the unmodified re-entrant groove. The convergent entrances bring about improved fluid flow into the capillary channels in the condenser section, and supply appropriate surfaces in the evaporator section for the formation of thin films of working fluid to allow heat to be conducted more readily from the surface of the heat pipe to the surface of the fluid where evaporation takes place.

Thus, the same hybrid groove shape of the present invention may be used uniformly throughout the length of a heat pipe, providing improved thermal performance while simplifying fabrication.

BRIEF DESCRIPTION OF THE DRAWINGS

The foregoing and other advantages of the present invention are more fully explained in the attending description of a preferred embodiment, a better understanding of which may be had by reference to the drawings, in which.

DETAILED DESCRIPTION OF PREFERRED EMBODIMENTS

Figure 1:
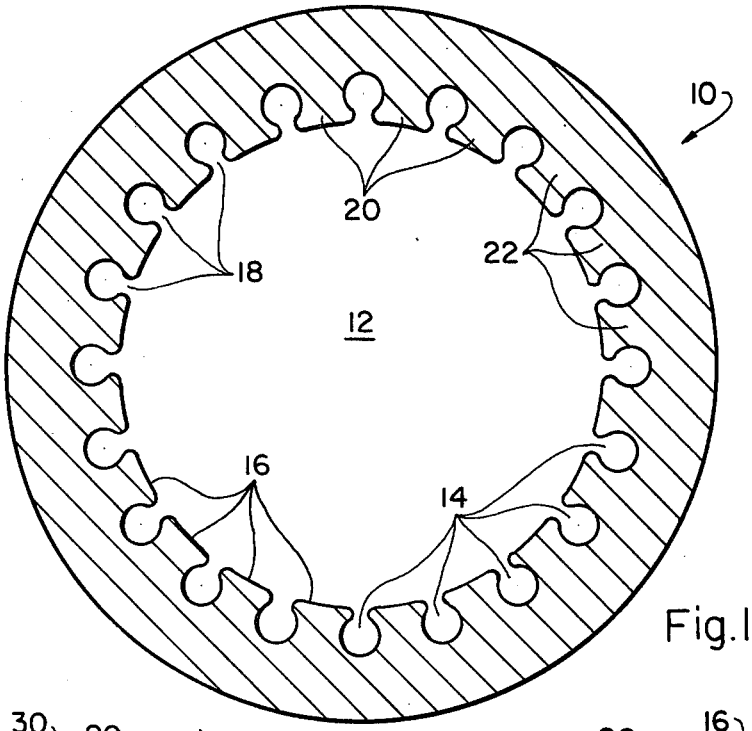
Fig. 1 PRIOR ART
FIG. 1 is a cross section of a prior art, re-entrant groove heat pipe.

FIG. 1 shows, in cross section, a commercially available extruded tube 10 which may be cut to a desired length, sealed at either end, as by crimping and/or welding, and injected with a suitable coolant or working fluid to form a heat pipe. A vapor flow channel 12 is enclosed by the wall of the tube 10, while a plurality of capillary or fluid flow channels 14 are formed within the wall itself. Each channel 14 is defined by an adjacent pair of parallel ribs 16 projecting inwardly toward the central vapor flow channel 12. A plurality of re-entrant groove openings 18 in one-to-one correspondence with channels 14 provide communication between channels 14 and channel 12. Each rib 16 has a rounded head portion 20 which is relatively thicker than the rib's base portion 22, resulting in a re-entrant profile wherein openings 18 are narrower than capillary channels 14.

Figure 2:
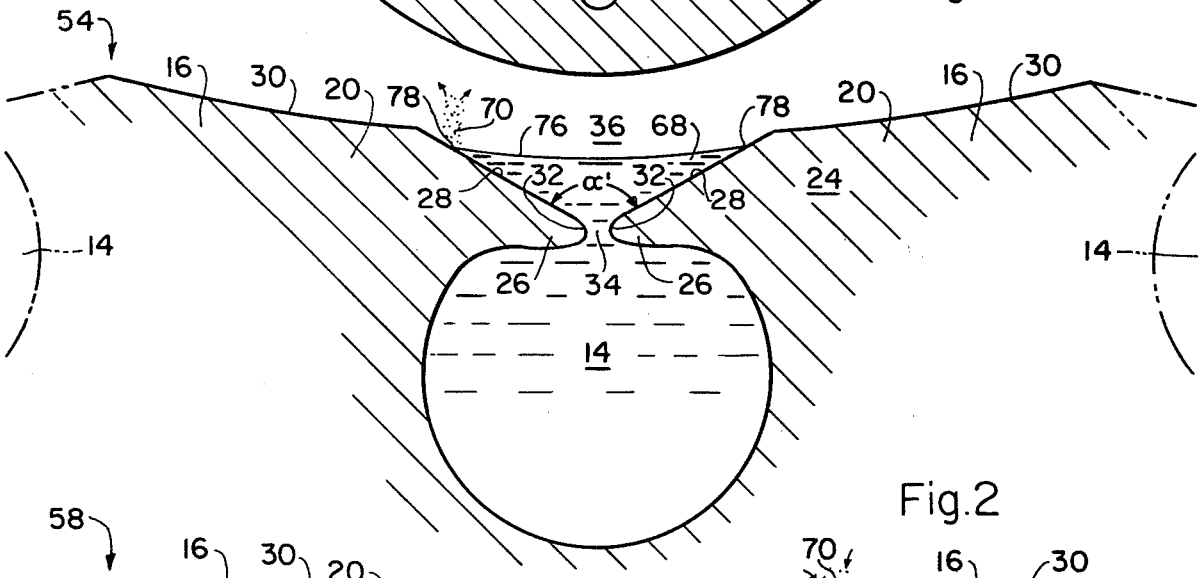
FIGS. 2 and 3 are cross sections of a modified re-entrant groove.
Figure 3:
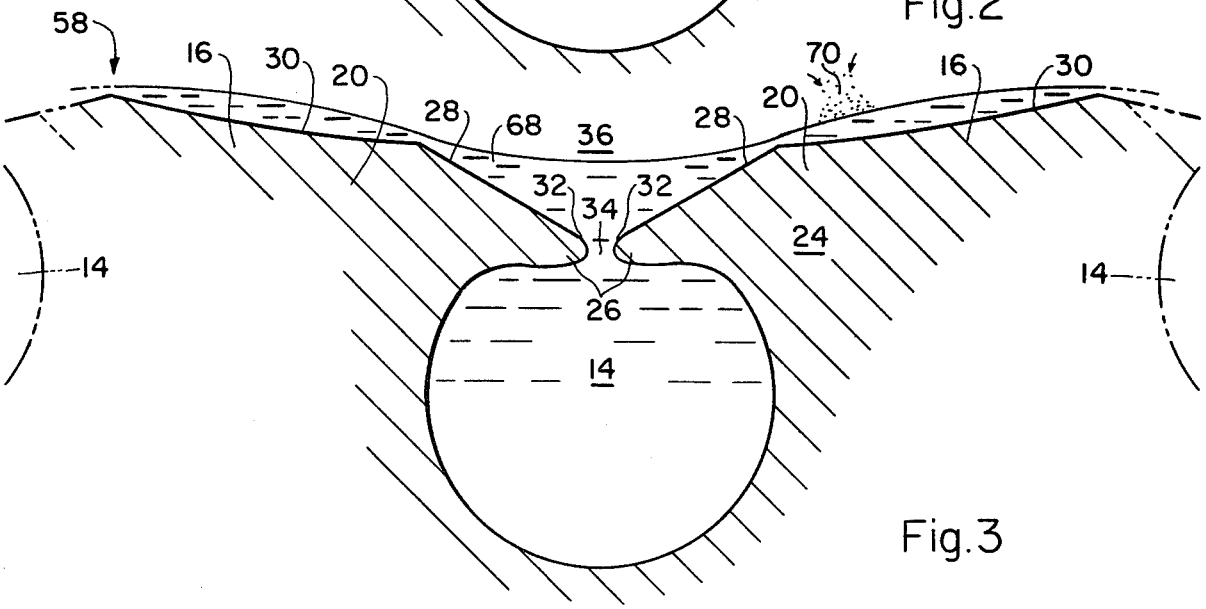

FIGS. 2 and 3 show partial cross sections of a heat pipe 24 formed from a tube 10 which has been modified according to the present invention. As modified, each rib 16 includes a pair of transverse fins 26 projecting from opposite sides of head portion 20. Each adjacent pair of ribs 16 thus includes a facing pair of transverse fins 26 which project toward each other.

Each transverse fin 26 provides a flat sloping surface 28 extending from inner surface 30 of associated rib 16 to a tip 32 of the fin. The resulting re-entrant groove profile includes modified, narrowed groove openings 34 with convergent entrances 36. Each facing pair of transverse fins 26 borders an associated opening 34, while the sloping surfaces 28 of a facing pair of fins define the convergent entrance 36 to the associated channel 14.

Figure 4:
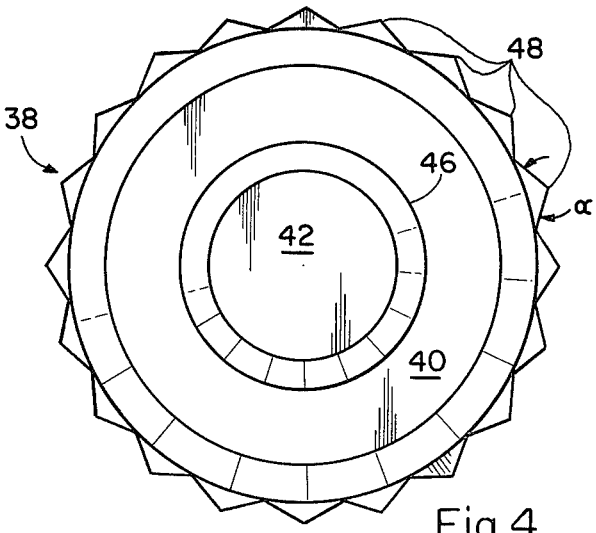
FIG. 4 is a front elevation of a mandrel for modifying extruded pipes.
Figure 5:
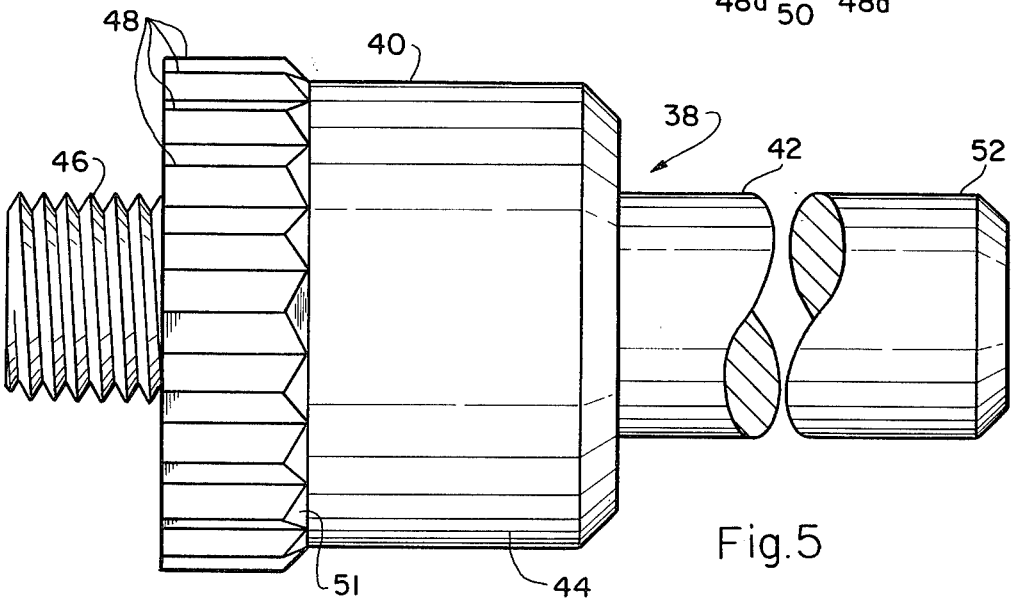
FIG. 5 is a side elevation of FIG. 4.

According to the present invention, the convergent re-entrant groove profile is achieved by modifying the commercially available, extruded tube 10 of FIG. 1. FIGS. 4 and 5 illustrate a tool 38 which may be used to modify the groove profile of tube 10.

As seen in FIG. 5, tool 38 comprises a mandrel 40 and a draw bar 42. Mandrel 40 includes a forward supporting section 44 and threaded hollow for engagement on threaded end 46 of draw bar 42. The length of draw bar 42 should be at least greater than the length of tube 10 to be operated on.

Figure 4A:
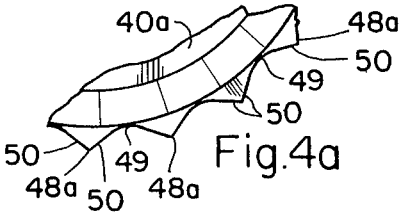
FIG. 4*a* is a partial front elevation of another mandrel.

The periphery of mandrel 40 includes a plurality of axial, V-shaped spines 48 corresponding to grooves 18 on tube 10. The apex angle $\alpha$of spines 48 corresponds to a desired convergent entrance angle $\alpha'$ in the modified groove profile (FIG. 4). If a different profile of convergent entrance 36 is desired, the shape of spines 48 is chosen accordingly. FIG. 4*a*, for example, shows a slightly varied mandrel 40*a* in which the troughs 49 between spines 48*a* are curved, the radius of curvature increasing from the midpoint of each trough to flat portions 50 of each spine. A chamber 51 (FIG. 5) is provided at the forward end of the spine section for proper engagement and alignment with grooves 18.

Modification of the virgin extrusion is accomplished by inserting draw bar 42 into a desired length of tube 10 so that the draw bar extends beyond either end of the tube's length. Splines 48 on mandrel 40 and groove openings 18 on tube 10 are next aligned with each other by rotating tool 38 relative to the tube. It should be obvious that draw bar 42 may be inserted into tube 10 prior to attaching mandrel 40, in which case the draw bar may be inserted either end first.

When the mandrel and tube are properly aligned, mandrel 40 is drawn through tube 10 by forcing end 52 of draw bar 42 axially away from tube 10. As mandrel 40 passes through tube 10, material from the rounded head portion 20 of each rib 16 is forced inward toward capillary channels 14 to form transverse fins 26. This material displacement results in re-entrant groove openings 34 with widths on the order of 0.001 to 0.004 inches. Attempts in the past to produce such narrow re-entrant grooves by direct extrusion have generally been unsuccessful, because the extrusion die is necessarily thin and hence very fragile at the points corresponding to the re-entrant grooves. The heat and pressure exerted on the die during the extrusion process has inevitably resulted in the die's fracturing before any useful length of pipe can be produced.

By contrast, the present method may be used to produce relatively long (greater than one or two feet), single-piece tubes having relatively narrow (less than 0.004 in.) groove openings which have heretofore been unavailable in the art. Because the desired length of tube may be produced in a single piece, there is no need to splice smaller lengths together, a process involving considerable expense and loss of efficiency in the resulting heat pipe.

Figure 6:
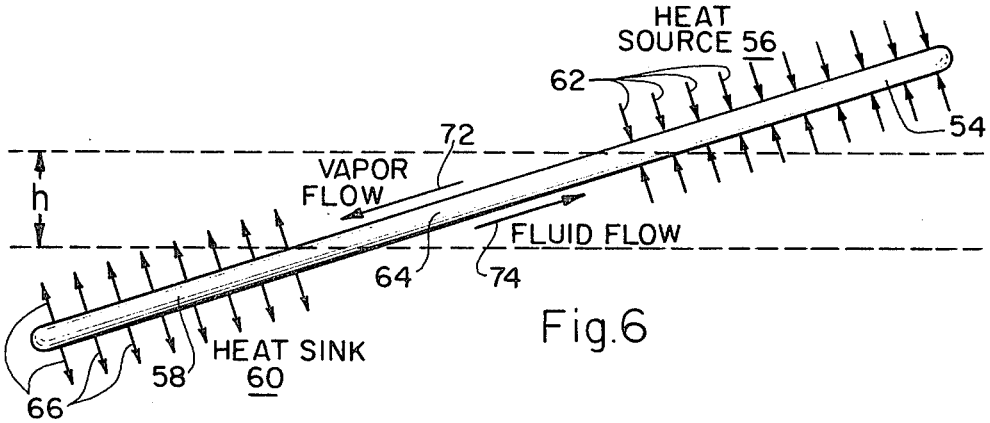
FIG. 6 is a schematic view of a modified re-entrant groove heat pipe.

The operation of heat pipe 24 is shown schematically in FIG. 6. Structurally, heat pipe 24 is a sealed chamber formed from a modified length of re-entrant groove tube in the same manner as prior art heat pipes would be formed from virgin extrusions.

The heat pipe 24 is positioned so that one end, the evaporator 54, is located in a heat source region 56 and the other end, condenser 58, is in heat sink region 60. Heat is absorbed as indicated by arrows 62, conducted through transport region 64, which may be insulated, and heat is given off as indicated by arrows 66.

Absorption of thermal energy in the evaporator 54 causes evaporation of a working fluid 68 (FIG. 2) while condensation of vaporized working fluid 70 in the condensor section 58 effects a release of thermal energy (FIG. 3). Vapor channel 12 serves to conduct vaporized fluid 70 from evaporator 54 to condenser 58, and capillary channels 14 bring condensed fluid 68 from the condenser back to the evaporator. Arrows 72 and 74 (FIG. 6) indicate the direction of vapor and fluid flow through the heat pipe 24.

While FIG. 6 illustrates the case where heat is conducted from a higher heat source to a relatively lower heat sink, as indicated by adverse tilt h, heat pipes constructed according to the present invention could also be used to conduct heat from a relatively lower source to a higher sink. In this latter situation, gravity would tend to assist the flow of condensed working fluid. Otherwise, the utility of the heat pipe is limited by its static wicking height, which is the maximum adverse tilt, or vertical difference separating a higher source from a lower sink, at which the heat pipe will operate. Unmodified (virgin extruded aluminum) heat pipes have been shown to have static wicking heights of 0.6 in., using ammonia as the working fluid, while heat pipes constructed according to the present invention, using the same working fluid, have displayed static wicking heights of 1.8 in. This increase in static wicking height afforded by the present invention is made possible in part by the narrowed groove openings, which allow a more complete enclosure of capillary channels 14 and a concurrent increase in the surface area over which capillary action may occur.

Referring to FIG. 2, working fluid 68 is seen to form a concave meniscus 76 in each convergent entrance 36 in evaporator section 54. It is at the tips 78 of each meniscus that working fluid layer is thinnest. As is known in the art, heat transfer is improved by providing a thin layer of working fluid, because heat must pass through the working fluid to cause evaporation at the surface, and working fluids generally exhibit a much lower thermal conductivity than the material from which the wall of a heat pipe is formed. Thus it becomes obvious that the heat transfer properties of the present invention may be altered by adjusting the convergent entrance angle $\alpha'$, which conforms to the apex angle of the splines 48 of mandrel 40, to better approximate a tangent to the meniscus of working fluid in the evaporator. Splines 48 could also be made in other than a V-shape, to allow greater conformance with meniscus 76.

Similarly, angle $\alpha'$ affects the flow of condensed working fluid into groove openings 34. As seen in FIG. 3, vaporized fluid 70 condenses on surfaces 30 in the condenser section 58, and is urged by capillary action along sloping surfaces 28 toward groove openings 34. By conducting the condensed working fluid away from surfaces 30 more efficiently, the present invention affords improved heat transfer in the condenser section. Even further advances in condenser efficiency may be obtained by precisely controlling the profile of inner surfaces 30. As in the evaporator, condenser heat transfer will be improved by providing thin condensation films, since heat from the vapor must be conducted through the film to surfaces 30. Also, an increasing radius of curvature from the midpoint of each surface 30 results in a capillary pumping action of the condensed working fluid toward the re-entrant grooves. Both of these effects may be achieved by using a mandrel such as that of FIG. 4*a* which contacts the the entire surface of each rib between the re-entrant grooves during modification.

Nevertheless, it has been found that, using a mandrel having simple V-shaped splines with an apex angle of about 110° to modify according to the present invention an extruded aluminum tube having 20 re-entrant grooves and an inside diameter of about 0.4 in., heat pipes made from such modified tubes exhibit the following improved characteristics over heat pipes made from the same tubing without such modification (both using ammonia as the working fluid):

| | | Unmodified (Prior Art) | Modified According to Present Invention |
|---|---|---|---|
| Static Wicking Height | | 0.6 in. | 1.8 in. |
| Heat Transfer ($W/M^{2\circ}$ C.): | Evaporator | 2000 | 7900 |
| | Condenser | 5400 | 14,000 |

While the foregoing example is a specific illustration of the improvements occasioned by use of the present invention, it is not intended to be limiting. Thus, one skilled in the art will realize that the selection of a working fluid, the number of capillary channels, the diameter of the tube, and the angle and/or shape of the convergent entrance may be varied according to a particular application, without departing from the spirit of the present invention, the scope of which is defined by the claims which follow.

What is claimed is:

1. A method for making a convergent, re-entrant groove heat pipe comprising:

forming a desired length of seamless tube with a plurality of longitudinal capillary channels in a wall thereof and a like plurality of re-entrant groove openings each providing communication between an associated one of the capillary channels and a central channel of the tube, said capillary channels and associated re-entrant openings being defined by a like plurality of ribs each projecting inwardly toward the central channel of the tube and having a head portion closest to the central channel relatively thicker than a base portion thereof whereby the re-entrant openings are narrower than the capillary channels;

aligning the tube with a mandrel having a plurality of spines shaped to correspond to a desired re-entrant groove entrance profile such that each spine is centered between adjacent ribs in one of the re-entrant groove openings;

drawing the mandrel through the tube such that rib material on either side of each re-entrant groove opening is displaced while material from a central portion of each rib remains undisplaced, resulting in a convergent, re-entrant groove profile;

sealing the tube at either end; and injecting the tube with a suitable working fluid.

2. The method of claim 1 in which the spines are V-shaped and have an apex angle corresponding to a desired angle of convergent entrance.

3. The method of claim 1 in which the spines define a plurality of troughs, each trough having a radius of curvature which increases from a midpoint of the trough to a flat portion of the adjacent spines.

4. The method of claim 1 wherein the step of drawing the mandrel through the tube comprises:

inserting a draw bar into the tube;

attaching the mandrel to a first end of the draw bar; and forcing a second end of the draw bar axially away from the tube.

* * * * *

UNITED STATES PATENT AND TRADEMARK OFFICE

CERTIFICATE OF CORRECTION

PATENT NO. : 4,457,059

DATED : Jul. 3, 1984

INVENTOR(S) : Joseph P. Alario et al

It is certified that error appears in the above-identified patent and that said Letters Patent are hereby corrected as shown below:

Col. 4, line 7, add a space after "alpha"

Col. 4, line 15, "chamber" should read -- chamfer --.

Signed and Sealed this

*Eleventh* Day of *December 1984*

[SEAL]

*Attest:*

GERALD J. MOSSINGHOFF

*Attesting Officer*

*Commissioner of Patents and Trademarks*